United States Patent [19]

Tamny

[11] 3,934,055

[45] Jan. 20, 1976

[54] ELECTROSTATIC SPRAY METHOD

[75] Inventor: Simon Z. Tamny, Lorain, Ohio

[73] Assignee: Nordson Corporation, Amherst, Ohio

[22] Filed: Jan. 23, 1975

[21] Appl. No.: 543,249

Related U.S. Application Data

[62] Division of Ser. No. 465,539, April 30, 1974, Pat. No. 3,892,357.

[52] U.S. Cl. ..... 427/8; 239/3; 427/27

[51] Int. Cl.[2] ..... B05D 1/06

[58] Field of Search ..... 427/13, 27, 30, 31, 32, 427/33, 8; 239/3, 15; 118/621, 629, 627

[56] References Cited

UNITED STATES PATENTS

| | | | |
|---|---|---|---|
| 3,122,320 | 2/1964 | Beck et al. | 239/15 |
| 3,467,541 | 9/1969 | Aronsson et al. | 427/32 |
| 3,747,850 | 7/1973 | Hastings et al. | 239/15 |
| 3,893,620 | 7/1975 | Rokadia | 118/629 |

*Primary Examiner*—J. H. Newsome
*Attorney, Agent, or Firm*—Wood, Herron & Evans

[57] ABSTRACT

An electrostatic spray apparatus and method for spraying electrically conductive coating materials on a continuous basis from an electrically grounded bulk coating supply. Included is a spray gun from which electrostatically charged coating material is emitted toward an electrically grounded object to be coated; a high voltage source for electrostatically charging the coating material emitted from the gun; an electrically grounded bulk coating storage tank; and an intermediate tank assembly including a) an inner tank for continuously supplying coating to the gun via a hose, which inner tank is automatically and periodically replenished with coating material from the grounded bulk supply tank without establishing an electrically conductive path between the electrically grounded bulk storage tank and the inner tank which contains coating material electrostatically charged via the column of conductive coating material in the gun hose, b) an electrically grounded outer housing or container completely enclosing the inner tank, and c) an insulative support electrically isolating the inner tank from the outer grounded container, which support is subjected to a gaseous stream to prevent build-up thereon of a conductive film of coating material which, if permitted to occur, would shortcircuit the grounded outer container to the electrostatically charged coating material stored in the inner tank and thereby destroy the electrical isolation between the inner tank and the grounded outer container.

9 Claims, 1 Drawing Figure

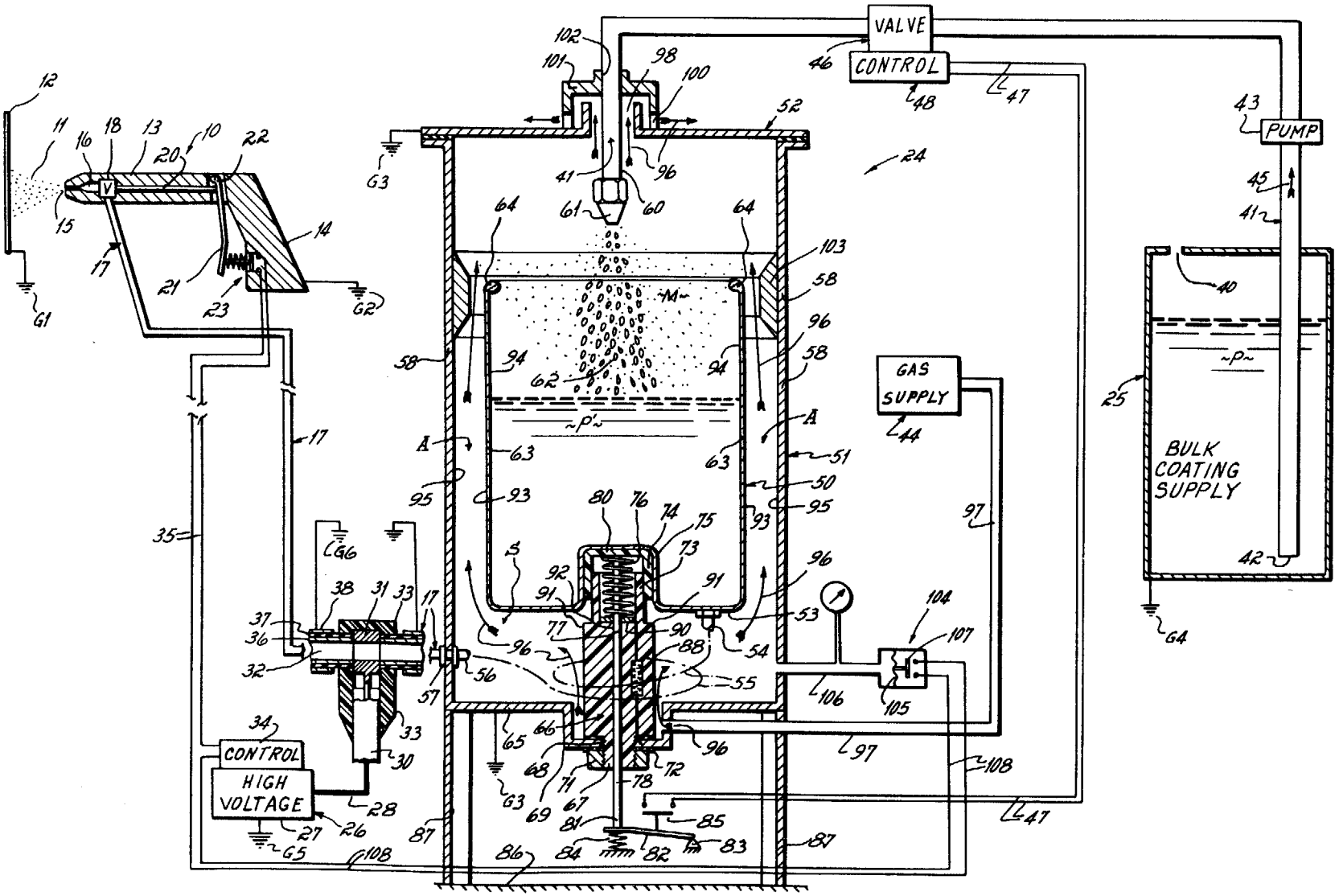
PUMP
BULK COATING SUPPLY
VALVE
CONTROL
GAS SUPPLY
HIGH VOLTAGE
CONTROL

ELECTROSTATIC SPRAY METHOD

This is a division of application Ser. No. 465,539 filed Apr. 30, 1974 now U.S. Pat. No. 3,892,357.

This invention relates to electrostatic spray coating and more particularly to an apparatus and method for electrostatically spray coating electrically conductive coating materials on a continuous basis which permits all exposed elements of the spraying apparatus to be electrically grounded, thereby avoiding shock and ignition hazards occasioned by inadvertent contact by operating personnel with, and/or accidental grounding of, any exposed portion of the system.

Coating materials sprayed on objects to be coated can be categorized, from the standpoint of their electrical conductivity, as falling into one of three categories, namely, low, intermediate or moderate, and high conductivity coatings. Coating resistivities in the general range of $2\times10^5$ ohm-centimeters to $10^6$ ohm-centimeters are considered to be in the intermediate or moderate conductivity range, while coating materials having electrical resistivities below and above this range are viewed as falling in the high and low conductivity categories, respectively. While specific resistivity values have been used to define low, intermediate and high conductivity ranges, it is understood that these resistivity values are arbitrary and relative, and employed only for the purpose of illustration. Accordingly, a coating material having a resistivity above or below the range of $2\times10^5$–$10^6$ ohm-centimeters could conceivably be considered as an intermediate or moderate conductivity coating material, notwithstanding that it falls without, although near, the specific numerical range noted. Similarly, a coating material with a resistivity between $2\times10^5$ ohm-centimeters and $10^6$ ohm-centimeters, near one or the other of these limits, may possibly be considered as either a high or low conductivity coating depending on the end of the intermediate range to which it is closest. As used herein, the term "electrically conductive coating material" refers to coating materials of both the intermediate and high conductivity types.

Heretofore there has been no commercially feasible method or apparatus for spraying, on a continuous basis (vis-a-vis batching operation), an electrostatically charged flow of conductive coating material in which all elements of the spray coating system exposed to the environment are electrically grounded, thereby permitting an operator to contact any exposed portion of the entire spray equipment system without risk of electrical shock and/or accommodating accidental grounding of any exposed portion of the system without risk of ignition hazards should the equipment be located in an explosive environment as is the case when petrochemical solvent-based paints are being sprayed.

In one spray system proposed in German patent No. 2,019,466 designed for coating articles with electrically conductive paint, which is not susceptive of continuous operation, the paint supply tank, which is connected to the gun via a hose, is located on an electrically nonconductive stand or platform spaced above the floor (which is at ground potential) a distance sufficient to avoid arcing or dielectric breakdown of the air between the tank and floor. This is necessary as a consequence of the fact that the contents of the tank are at the charging potential by reason of the conductive column of paint in the hose which interconnects the spray gun electrode and the tank contents. With such an arrangement, and assuming the tank is fabricated of electrically conductive material which is not uncommon, the exposed surface of the tank is electrostatically charged at the operating potential. An operator inadvertently contacting the tank risks serious electrical shock. Additionally, should a grounded object accidentally contact the tank, there is presented a significant ignition hazard where the conductive paint is of the petrochemical solvent-based type, since the environment is likely to be explosive.

Of course, the foregoing shock and ignition hazards can be minimized by limiting access to the tank by, for example, placing the tank in an area which is fenced off. However, this is inconvenient, adds to the cost of the system, and does not permit the tank to be conveniently moved when the spray equipment is utilized at different locations within the plant.

In accordance with the proposal of German patent No. 2,128,455 also directed to a batch-type operation, the ignition and shock hazards attendant operator contact and/or accidental grounding of the electrostatically charged paint tank are considered to be overcome by completely encasing the electrostatically charged paint tank within an insulative housing, such as a tank fabricated of nonconductive material of much larger size within which the electrostatically charged paint tank can be placed.

However, a distinct disadvantage of each of the foregoing proposals is that they permit only batch type, and not continuous, spraying by reason of the fact that the amount of spraying which can be done during any given interval is limited by the size of the tank. Once the contents of the tank have been consumed it is necessary to interrupt the spraying operation, de-energize the electrostatic generator, electrically ground the tank to discharge any electrostatic charge which accumulated on it during the spraying operation, open the tank and replenish the tank supply from a bulk storage paint supply such as from a large drum or the like. After all this has been done, and then only, can the tank be closed and the electrostatic spray coating operation resumed. This kind of operation is known as "batch-type" spraying, vis-a-vis "continuous" spraying.

Furthermore, a large nonconductive enclosure immediately surrounding a high voltage electrostatic source, as in the second of the foregoing proposals, tends to accumulate charge inbalance on its inner and outer surfaces leading to a secondary shock hazard upon contact by an operator.

In accordance with a further proposal described in U.S. Pat. No. 3,122,320, it is suggested that a system for coating with electrically conductive paint on a continuous basis (non-batch) from a first electrostatically charged tank which feeds the gun can be provided by replenishing the conductive paint in the first tank from a second grounded bulk supply tank which sprays the paint into the first tank thereby presumably avoiding electrical continuity between the bulk supply tank which is grounded and the tank connected to the gun which is charged. While this proposal might conceivably permit conductive paint to be electrostatically sprayed on a continuous basis, it does not overcome the shock and ignition hazards which attend inadvertent contact of the exposed electrostatically charged portions of the system by an operator and/or grounded object.

Accordingly, it has been an objective of this invention to provide an apparatus and method for electrostatically spraying conductive paint on a continuous (non-batch) basis free of shock and ignition hazards occasioned by inadvertent contact of exposed portions of the apparatus by an operator and/or other grounded article. This objective has been accomplished in accordance with certain of the principles of this invention by supplying, via a hose, electrically conductive paint to a gun from a paint tank which is enclosed within and spaced from an outer electrically grounded tank-enclosing container, the spaced relation being provided by an insulative support member physically contacting both the inner tank and outer container and over which a gas flow is directed to prevent deposition thereon of an electrically conductive paint film which if permitted to accumulate would provide a conductive path between the electrostatically charged inner tank and the outer electrically grounded container; and by further providing an electrically grounded source of bulk coating material and material conveying means interconnecting the bulk source and the inner tank for transferring material therebetween without establishing an electrically conductive path between the bulk source and the inner tank.

In accordance with a preferred embodiment of the invention the inner tank is open at the top and spaced from the outer grounded container by means of an insulative support extending between the spaced superimposed bases thereof, with the uncharged conductive coating material from the electrically grounded bulk supply tank being introduced in a discontinuous fashion into the inner tank from a hose passing through the top of the outer container. As a consequence of supplying conductive coating material to the inner tank from the electrically grounded bulk supply without establishing an electrically conductive path between the bulk source and the electrostatically charged material stored in the inner tank, continuous (non-batch) spray coating is possible utilizing an electrically grounded bulk paint supply.

Additionally, and by reason of directing a gas stream over the insulative support which spaces the inner tank from the electrically grounded outer container, and electrically conductive film of coating material originating from, for example, vaporized paint within the open-topped inner tank, is not permitted to accumulate on the tank support structure, which support structure constitutes the only direct physical link between the electrostatically charged inner container and the electrically grounded outer container, thereby preventing the creation of a short-circuit path between the inner electrostatically charged tank and the grounded outer container. A further advantage, attributable to placement at the bottom of the open-topped inner tank of the insulative support which spaces the inner tank from the outer grounded container, is that the distance between (a) the open top of the inner tank whereat conductive coating vapors concentrate and (b) the support which constitutes the only potential short-circuit path between the inner and outer tanks, is maximized to further reduce the possibility of a conductive film accumulating on the support and short-circuiting the inner and outer tanks.

In accordance with a further aspect of the invention, the gas flow, in addition to being directed over the insulative support which spaces the inner and outer tanks, is also directed vertically upwardly in the annular region between the inner and outer tanks with a velocity which exceeds the downwardly directed terminal velocity of vaporized coating particles or droplets tending to move downwardly toward the insulative tank support under the force of gravity. This further enhances the likelihood that an electrically conductive film will not be deposited on the support linking the inner and outer tanks.

In a preferred form of the invention an area restrictor in the form of a nonconductive circular ring is mounted in the annular flow region between the inner and outer tanks proximate the upper edge of the inner tank. Such an area restrictor, when positioned in the manner indicated, increases the local upward velocity of the gas stream in the region of the inner tank opening, whereat particles or droplets of conductive coating from the mist located above the stored coating in the inner tank would tend to enter the annular flow region between the tanks in the course of moving downwardly toward the tank support.

In accordance with a further feature of the invention, the gas stream is provided from a pressurized source of low moisture content gas via a suitable hose or the like. This has the dual advantage of pressurizing the contents of the inner tank to provide a pressurized flow of coating to the spray gun and promoting evaporation of any coating which might condense on the inner tank support.

Assuming the gas utilized to sweep the tank support and provide pressurized coating flow is also non-toxic and nonexplosive, very simple means can be utilized to exhaust the gas from the outer container. Specifically, such gas flow exhaust means can take the form of a simple vent provided in the top of the outer container above the inner tank through which the gas is vented, which is introduced at the bottom of the container, exhausts to the atmosphere. Such a gas exhaust arrangement does not create enviromental pollution hazards nor does it create ignition hazards.

These and other advantages and objectives of the invention will become more readily apparent from a detailed description of the drawing in which the figure is a schematic diagram of a preferred embodiment of a coating material spray system incorporating the principles of this invention.

The preferred embodiment, as shown in the figure, includes a spray device 10, preferably in the form of a hand-held spray gun, for emitting electrostatically charged coating material 11, e.g., electrically conductive water-based paint, toward an object 12 to be coated which is maintained at an electrical potential substantially different from that of the charged coating material emitted from the spray gun. In practice, the coating material 11 as emitted from the gun 10 is in atomized droplet or particulate form as is well known in the electrostatic coating field, such atomization or the like being accomplished in accordance with conventional airless spray, air spray, or electrostatic atomization principles. The emitted material 11 is typically electrostatically charged to a potential in the range of 50 kv – 100 kv, although potentials outside this range are possible, while the article 12 to be coated is typically maintained at zero or ground potential as indicated by ground connection G1.

While the advantages provided by the instant invention are perhaps greatest when a spray device of the manually held variety is used, it is to be understood that the invention can also be used with stationary spray devices secured to a fixed stationary support, as well as movable spray devices used in automatic spray systems in which the spray device is mounted on a movable support which reciprocates vertically and/or horizontally in response to control signals generated by a suitable position controller.

The gun 10 includes an elongated barrel 13 fabricated of electrically insulative material and a handle 14 fabricated of electrically conductive material. The spray gun handle 14 is customarily electrically grounded as shown by ground connection G2. The longitudinal length of the insulative barrel 13, which establishes the distance between the emission point or nozzle 15, whereat the electrostatically charged material 11 leaves the gun, and the electrically conductive handle 14, should be selected to provide an "electrical standoff," i.e., avoid arcing, Corona discharge, undesirable electrical shunt current levels and the like, between the handle and the nozzle. Located within the gun is a conduit 16 through which paint, supplied to the gun via a hose 17 from a remote source to be described, flows to the nozzle 15. Connected in the conduit 16 is a paint flow valve 18 having an actuating plunger 20 which reciprocates under the action of a movable finger-operated trigger 21 pivoted to the gun at 22. Inward and outward movement of the trigger 21 reciprocates the plunger 20 to open and close the flow valve 18 respectively, regulating the flow of paint from the gun in a manner to be described. Also operated by the trigger 21 is a normally open-circuited electrical switch 23 which, when the trigger 21 is depressed, is placed in a closed-circuit condition to initiate the application of an electrostatic charging potential to the paint in a manner also to be described hereafter.

To provide the capability of supplying the gun 10, via the hose or conduit 17, with electrically conductive paint on a continuous basis, an intermittently refillable intermediate tank assembly 24 and a bulk coating supply tank 25, both of which are grounded, as indicated by ground connections G3 and G4, are provided. The supply of electrically conductive paint to the gun 10 on a "continuous" basis from an electrically grounded paint supply, as is possible with the apparatus and method of this invention, is to be distinguished from what is known as "batch-type" operation. In such operation the tank directly supplying paint to the gun via an interconnecting hose supplies the gun with paint only until the contents of the tank are depleted, at which time it is necessary to stop the painting operation, electrically discharge the tank, open the tank and refill it with a new supply of paint, following which the tank is closed and the spraying of electrostatically charged paint resumed. The significance of the fact that electrically conductive paint is supplied via hose 17 to the gun 10 on a continuous basis from tanks 24 and 25 which are electrically grounded will become apparent hereafter. It is sufficient at this point to note only that by utilizing electrically grounded tanks 24 and 25 electrically conductive paint can be supplied continuously by hose 17 to the gun 10 without need for locating the tanks 24 and 25 on specially constructed dielectric platforms in areas which have been fenced off or otherwise made inaccessible for the purpose of avoiding electrical shock and ignition hazards which attend exposure of high voltage equipment to operating personnel and/or inadvertent grounding.

A high voltage electrostatic generator 26 of conventional design, having a housing 27 electrically grounded as shown schematically by ground connection G5, provides at its output conductor 28 an electrostatic potential sufficient in magnitude to charge the paint 11 emitted from nozzle 15 to the desired level. In a preferred form the high voltage output 28 is electrically connected via an insulated element 30 to an electrically conductive electrode in the form of a ring 31 located within the bore 32 of the paint hose 17 such that paint flowing through the hose is electrostatically charged at the voltage output from the generator 26 on line 28. Since the paint flowing through the hose 17 is electrically conductive, the coating material 11 emitted from the nozzle 15 will be electrostatically charged to essentially the potential of the ring 31 via the electrically conductive paint column in the hose 17 between the electrode ring 31 and the nozzle 15. A suitable electrically insulative fitting 33 surrounds and seals the insulated elements 30 and the hose 17 in the region of the charging electrode ring 31. A suitable control 34 is operatively connected to the high voltage generator 26 for controlling the ON and OFF state of the generator in response to actuation of the trigger 21 via electrical control wires 35, as will become more apparent hereafter.

While electrostatic charging of the emitted electrically conductive coating material 11 is accomplished in the preferred embodiment by charging the electrically conductive paint as it moves through the hose 17, other methods are possible. For example, the emitted coating material 11 can be electrostatically charged in the region of the nozzle 15 by mounting an electrode (not shown) in the vicinity of the nozzle, which electrode is electrically connected to the high voltage generator output line 28 via a suitable insulated cable (not shown). However, such an arrangement has the disadvantage of requiring that a cable, insulated for high voltage, be connected to the gun, making the gun more cumbersome to handle and increasing electrical shock and ignition hazards occasioned by the added electrical energy capacitively stored in the cable. However, this disadvantage of a gunmounted high voltage electrode can be overcome by mounting the high voltage generator within the gun as disclosed and claimed in Senay U.S. Pat. No. 3,731,145, assigned to the assignee of this application. A still further alternative method of electrostatically charging the electrically conductive material 11 emitted from the gun 10 is to connect the output 28 from the high voltage generator 26 to the tank containing the paint which feeds hose 17 such that it makes electrical contact with the coating material therein, as described, for example, in U.S. Pat. No 3,794,243, assigned to the assignee of this application.

The hose 17, which transports electrostatically charged paint within its bore 32 from the intermediate tank assembly 24 to the gun 10, preferably has an interior layer or zone 36 which is impermeable and chemically inert with respect to the electrically conductive paint flowing through the bore 32, an intermediate insulative layer 37 which, in combination with the layer 36, has a dielectric strength sufficient to prevent dielectric breakdown when subjected to the charging potential by the electrostatically charged conductive paint flowing in the bore 32. Preferably surrounding and in physical contact with the intermediate layer 37 is an electrically conductive element 38 which is grounded as schematically shown by ground connection G6. The grounded element 38 prevents the accumulation of electrical charge on the exterior of the hose 17 occasioned by minor current leakage radially through the hose from the electrostatically charged paint flowing therethrough. Accumulation of leakage charge on the exterior of the hose 17, which might otherwise occur were the electrically grounded conductive element 38 not provided, presents an ignition and/or electrical shock hazard should it accidentally become grounded in an explosive environment and/or contact an operator.

The bulk coating supply tank 25 which as noted previously is grounded at G4 can be fabricated of any suitable material and be shaped in any suitable form. Preferably the tank 25 has a large storage capacity, for example, 100 gallons or more. Located within tank 25, in which is stored a large quantity of electrically conductive paint P. is a paint circulating pump 43 having a suction end 42 located in the bottom region of the tank. The pump 43 provides a pressurized flow of paint in the tube 41 in the direction of arrow 45. Interconnected in the paint hose 41 is a suitable flow control valve 46 for regulating the flow of paint in hose 41 in response to a control input on lines 47 to an associated electrical control 48, such as a solenoid, derived in a manner to become apparent hereafter. The paint P can be replenished as needed through opening 40.

The intermediate tank assembly 24 is supplied with coating material from the bulk supply 25 under the control of valve 46 when the coating supply in tank assembly 24 reaches a predetermined depletion level. Intermediate tank assembly 24 includes an inner coating material container or tank 50, and an outer container, enclosure or tank 51 which encloses the inner tank. The outer tank 51 is preferably constructed of electrically conductive material, and as previously noted is electrically grounded as shown schematically at G3. The interior of the outer tank 51 is accessible from the outside for assembly and maintenance purposes via an opening in the top thereof which is normally closed with a selectively removable cover 52 through which passes the paint transporting hose 41 from bulk supply 25. The inner tank 50, which holds or stores a supply of electrically conductive paint P' is preferably fabricated of electrically conductive material. Extending from the bottom 53 of the tank 50 and communicating with the tank interior is one end 54 of an insulative helical paint conveying tube or hose 55, the other end 56 of which connects to the end of the paint hose 17 passing through a suitable located sealing grommet 57 positioned in an opening in the lower section of wall 58 of the outer tank 51. The helical tube 55 transports electrostatically charged paint from the interior of container 50 to the hose 17 for transmission to the gun 10. Since the electrically conductive paint within the bore 32 of the tube 17 is electrically charged at the potential of the output 28 of high voltage generator 26, the paint P' within the tank 50 is also at the electrostatic charging potential by reason of the electrically conductive paint column in hose 55 which interconnects the hose 17 with the interior of the inner tank 50.

To facilitate replenishing the supply of paint in inner tank 50 (which is at the electrostatic charging potential) from the bulk coating supply tank 25 (which is at grounded potential) via the hose 41 without placing the contents P of bulk coating supply tank 25, and in turn the tank 25 itself, at the electrostatic charging potential, the transfer of paint from the end 60 of the tube 41 to the inner tank 50 must be accomplished without establishing an electrically conductive path between the paint issuing from hose end 60 and the electrostatically charged paint P' located in the inner tank 50. To accomplish this, in accordance with a preferred embodiment of the invention, a nozzle 61 secured to the end 60 of the hose 41 is provided to divide the flow of paint issuing from hose 60 into an electrically discontinuous spray of particulate or droplet form, as shown schematically by the discrete particles 62. If electrical dicontinuity is to be obtained between the paint issuing from hose end 60 and the paint P' in the inner container 50 by use of a spray nozzle 61, a coarse spray is preferable to a fine spray or mist.

Alternatively, electrical discontinuity between the material flowing through hose end 60 and the paint P' in the inner container 50 can be obtained without use of a spray nozzle 61 by discharging the paint from the hose end 60 in timed, spaced, successive discrete quantities or pulses. Such could be accomplished by operating the control 48, which actuates the valve 46, in a pulsating mode in accordance with techniques well-known in the art.

To avoid arcing, Corona discharge and the like between the paint issuing from hose end 60 (or nozzle 61) which is at electrical ground potential and the paint P' in the inner container 50 which is at the electrostatic charging potential, it is necessary to position the hose end 60 (or nozzle 61) a distance from the maximum contemplated level of the paint P' sufficient to provide a suitable electrical standoff. Similarly, to avoid arcing, etc. between the ground potential paint issuing from hose end 60 (or nozzle 61) and the inner container 50 which is in contact with the electrostatically charged paint P', the shortest distance between the vertical side wall 63 and/or the upper edge 64 of the inner container 50 and the hose end 60 (or nozzle 61) must be sufficient to provide an electrical standoff. It is also essential to space the upper edge 64 of the inner container 50 which is at high electrostatic potential from the electrically grounded side wall 58 and cover 52 of the outer container 51 a sufficient distance to provide an electrical standoff condition.

To further reduce the possibility of arcing, Corona discharge and the like between the inner container edge 64 which is electrostatically charged and the ground potential outer container wall 58 and cover 52, the upper edge 64 should be smoothly contoured to avoid sharp edges which increase the concentration of the electrostatic field thereat.

It is also desirable to space the electrostatically charged vertical side wall 63 and the grounded outer container wall 58 from each other a distance sufficient to avoid arcing, Corona discharge and the like. Similarly, the electrostatically charged inner container bottom 53 and the grounded outer container bottom 65 should be spaced apart a distance sufficient to provide a suitable electrical standoff.

For example, at a typical electrostatic potential of 75 kv a standoff of approximately 6 inches between the conductive surfaces of the inner tank 50 and outer tank 51 may be expected to limit the average leakage current from tank 50 to tank 51 to less than 25 microamps. Efficient electrostatic coating requires that the power supply provide both a high potential to establish the necessary electrostatic field between the gun and work, as well as a current flow sufficient to electrically charge paint particles emitted from the spray gun. A further demand is imposed on the power supply by current leakage from the charged system to earth grounds other than the work piece. The power supply therefore must, if efficient coating is to be achieved, have sufficient capability to meet each of the foregoing demands. There is, however, a practical limit on power supply capability due to personnel hazards which are created as the power supply capability is increased beyond safe limits. To minimize this safety hazard, without deteriorating coating efficiency, current leakage must be held to a minimum.

To support and locate the inner container 50 relative to the outer container 51 as desired, a support structure 66 in the form of a vertically disposed column of insulative material is secured in fixed rigid relation to the outer container bottom 65. The lower end 67 of the insulative support column 66 preferably takes the form of a threaded stub which extends downwardly through an opening 68 provided in a cup-shaped central section 69 of the outer tank bottom 65. A nut 71 threads on the projecting portion of the stub 67 to lock the column 66 in its desired upright position. A grommet 72 disposed between the opening 68 and the threaded stub 67 seals the opening when the stub is locked in place with the threaded nut 71.

The upper end of the column 66 is provided with a tubular section 73 which telescopes within an inverted cup 74, preferably fabricated of conductive material, which snugly fits within an inverted recessed section 75 formed in the bottom 53 of the inner tank 50. A conductive compression spring 76 positioned within the tubular section 73 of the vertical support 66, for reasons to become apparent hereafter, applies an upward force to the bottom 53 of the inner tank 50.

Positioned within a vertical axially disposed bore 77 provided in the support column 66 in a longitudinal insulative element or rod 78, the upper end of which contacts the uppermost section 80 of the inverted cup 74. The bottom end 81 of the rod 78 contacts a lever 82 pivotally mounted at 83 which is upwardly biased by a compression spring 84. Mounted on the lever 82 is a switch 85.

When the supply of paint P′ in the inner container 50 reaches some predetermined depletion or low level and the inner container 50 has risen upwardly under the action of spring 76 to a specified point, the lever 82 biased by spring 84 pivots clockwise about spatially fixed point 83 causing switch 85 to complete a circuit through wires 47. This, in turn, causes the control 48 to open the valve 46, whereupon ground potential paint from the grounded bulk coating supply tank 25 is supplied via the hose 41 to the interior of the inner tank 50 to replenish electrostatically charged paint supply P′. As described previously, replenishment of tank 50 from bulk supply 25 is accomplished in an electrically discontinuous manner via the nozzle 61 which converts what could be an electrically continuous paint stream issuing from hose end 60 into an electrically discontinuous coarse spray 62.

By techniques commonly known, the actuation of switch 85 is provided with a dead band such that the inner tank 50 drops to a predetermined lower level as a consequence of being replenished with paint from the bulk supply 25 before switch 85 is disengaged to effect the closing of valve 46.

The detector or sensor for determining when it is necessary to replenish the supply of paint in the inner tank 50 may take a variety of forms other than the rod 78 movable with the inner tank 50 and switch arrangement 82, 83, 84 and 85. For example, level detectors or sensors operating on pneumatic, magnetic optical and like principles well-known to those skilled in the art could be employed. The particular detecting or sensing scheme shown in the figure and described herein is illustrative only.

To space the bottom 65 of the outer container 51 from the floor 86 or the like, the outer tank 51 is provided with a downwardly extending enclosure 87 which provides an accommodation space between the outer container bottom 65 and the floor 86 for the projecting end 81 of the movable actuating rod 78 and the switch 82, 83, 84 and 85. Of course, if the sensor used to detect the level of paint in the inner tank 50 were contained within outer container 51, or located other than below the bottom 65 of outer tank 51, outer tank 51 could be placed directly on floor 86, dispensing with the need for enclosure 87.

To provide a controlled bleed to ground potential of electrical charge accumulated on inner tank 50, and in the electrically charged paint P′ when the high voltage generator 26 is de-energized, a bleed resistor 88 is provided. Preferred resistance values for said bleed resistor would be in the range of 10–30g ohms, although a somewhat wider range would be acceptable. Resistor 88 is connected between the grounded outer container 51 and an electrically conductive washer 90 disposed between the bottom of the compression spring and the bottom of the tubular extension 73 of the support column 66. The bleed resistor 88 preferably is embedded within and completely surrounded by the insulative support column 66, although this is not necessary. Alternatively, the bleed resistor 88 could be directly connected between the grounded outer container 51 and the inner container 50 at any point along the bottom 53 or side walls 63 thereof. Of course, such an alternative resistor connection must avoid surface short-circuiting and should provide suitable accommodation for relative movement between the inner and outer containers 50 and 51 as occurs in the preferred embodiment wherein the inner container moves up and down depending upon the quantity of paint P′ stored therein at any given time.

Since any electrically conductive paint stored in the inner container 50 has a certain degree of volatility, a paint mist M will exist in the space above the stored paint P′ due to volatization or evaporation of the stored paint P′ in tank 50. This mist M will produce an electrically conductive paint film if allowed to deposit on the exterior surface 91 of column 66 or the interface 92 between column 66 and rod 78 which collectively space the inner and outer tanks, which surfaces are adjacent to the space S which communicates with the mist of conductive paint above the level of the paint P′ via annular path A between vertical tank walls 63 and 58. This electrically conductive paint film can complete an electrically conductive path between the outer tank 51 which is grounded and the electrically charged paint P′ stored in the inner tank. Such an electrically conductive path between the electrically charged paint P′ stored in the inner container 50 and the electrically grounded outer tank 51, if permitted to exist, would prevent electrical isolation of the electrostatically charged paint P′ from the grounded outer tank 51, resulting in an excessive current drain from the electrostatically charged portion of the system.

To avoid the above-described electrical path between the electrostatically charged paint P′ in tank 50 and the outer tank 51 established by deposition of an electrically conductive film of paint on the surfaces 91 annd 92, a flow of gas in an upward direction as indicated by arrow 96 is established in the space S between tank bottoms 53 and 65, and in the annular flow path A established by the vertical side wall 63 of inner tank 50 and the side wall 58 of outer tank 51. This upwardly directed gas flow 96 sweeps over tank support surface 91 and through the annular path A, preventing the accumulation of an electrically conductive paint film of the type described which, if permitted to occur, would electrically short-circuit the electrically grounded outer tank 51 to the electrically charged paint P' stored in the inner tank 50.

To provide gas flow 96, the supply 44 of gas is connected via a tube 97 to the space S between the inner and outer tank bottoms 53 and 65. Preferably the gas supply tube 97 is connected to the interior of the outer tank 51 at a point adjacent the bottom of the outer tank such that the entire exposed surface 91 of the tank support element 66 is subjected to the air flow 96. This maximizes the likelihood that an electrically conductive film of paint originating with the paint mist M existing in the inner container 50 above the level of the charged paint P' will not deposit an electrically conductive film on surfaces 91 and 92 and thereby not establish a short-circuit path between the outer tank 51 and the electrically charged stored paint P' in the inner tank.

The gas flow 96 is exhausted from the interior of the outer tank 51 at the top thereof via an exhaust path defined by an oversized bore 98 formed in the cover 52 loosely surrounding the downwardly extending paint hose 41 and lateral vent holes 100 formed in a fitting 101 mounted to the upper surface of the cover. A bore 102 in the fitting 101 snugly embraces the exterior of the paint hose 41.

The upward velocity of the gas stream 96 in the region of the edge 64 of the inner tank 50 is preferably selected to exceed the downward terminal velocity of paint particles from mist M entering the annular path A between the confronting walls 58 and 63 of the outer and inner tanks 51 and 50. This, in addition to the gas flow oversurface 91, insures that a paint particle entering the annular cavity A from mist M at a point proximate the edge 64 will not reach the bottom region or space S between the tank bottoms 65 and 53 to deposit on the surfaces 91 and 92. To increase the local velocity of the gas flow 96 in the annular flow path A proximate the edge 64, a nonconductive flow area restrictor 103 in the form of a circular ring having upper and lower beveled edges is secured to the wall 58 of the outer tank 51 opposite the upper edge 64 of the inner tank 50. The restrictor ring 103 produces a localized reduction in the area of annular flow path A proximate inner tank edge 64, thereby increasing the local velocity of the upwardly moving gas stream in the region of the edge 64.

Preferably the gas introduced into the space S and annular path A to establish the gas flow 96 is relatively moisture-free. This promotes evaporation of any paint film which could conceivably be deposited on the surfaces 91 and 92.

A sensor 104, in the form of a pressure responsive switch having a movable diaphragm 105 which communicates with the space S via a hose 106 is provided. A normally open electrical switch 107 closes to connect wires 108 when the pressure in the space S reaches a level correlated to the desired gas flow 96. Electrical bridging of wires 108 by the pressure-responsive switch 104, in series combination with electrical bridging of wires 35 by the trigger-actuated switch 23 occurring when the operator desires to paint the article 12, actuates the control 34 to energize the high voltage generator 26 and in turn electrostatically charge the paint passing through the hose 17 via the ring electrode 31. Thus, in the preferred embodiment electrostatic charging of the electrically conductive paint in the hose 17 which, as indicated, also electrostatically charges the stored paint P' via the paint column in hoses 17 and 55, can only occur when both the finger-actuated trigger 21 has been depressed and the gas supply 44 is operative to provide the gas flow 96.

In the event that cover 52 of outer tank 51 is opened, providing access to the electrostatically charged portion of the system, the pressure in the space S is immediately reduced, opening the pressure-responsive switch 104 and de-energizing the high voltage generator 26. The accumulated electrostatic charge is then quickly bled off to ground through bleed resistor 88.

The gas source 44, in addition to establishing a gas flow 96 in the container 51 via hose 97, additionally functions to pressurize the paint P' stored within inner tank 50 such that paint flows under pressure to the gun via hoses 55 and 17. Of course, as an alternative to pressurizing the flow, or as a supplement to it, a fluid pump (not shown) mounted to the bottom 53 of the inner tank 50 could be interconnected in the hose 55 adjacent the hose end 54 for pumping the charged paint from the inner tank 50 to the gun via hoses 55 and 17.

Significantly, the tank support structure 66 which, if coated with a film of conductive paint, would establish a short-circuit between the electrically grounded outer tank 51 and the electrically charged paint P', is located between the bottoms 53 and 65 of the inner and outer tanks 50 and 51. This maximizes the distance between (a) the potential short-circuit conductive paint film on surfaces 91 and 92 and (b) the mist M of conductive paint existing in the interior of the inner tank 50 above the level of the electrostatically charged paint P', which mist constitutes the source of the conductive paint film on surfaces 91 and 92. Maximization of this distance between the location of the mist M of electrically conductive paint and the potential short-circuit path creatable by the paint film on surfaces 91 and 92 minimizes the likelihood that the mist M will deposit on the surfaces 91 and 92 a film of conductive paint, in turn minimizing the likelihood that a short-circuit will occur between electrically grounded tank 51 and the electrostatically charged paint P' in the inner tank 50.

The helical shape of paint hose 55 between the bottom 53 of the vertically movable inner tank 50 and the stationary paint hose 17 enables the inner tank 50 to freely shift in a vertical direction as the level of the paint P' stored in the inner container 50 varies during use between replenishments of the inner tank via the valve-controlled bulk coating supply tank 25.

While the invention has been described in connection with preferred form of telescoping support 66, 74 for spacing and electrically isolating the inner and outer tanks 50 and 51, while simultaneously permitting relative movement therebetween to accommodate the paint level sensing function, other insulative support arrangements can be utilized to electrically isolate the inner and outer tanks. Additionally, while the tank isolating support in the preferred embodiment is located between the bottoms 53 and 65 of the inner and outer tanks 50 and 51, the support may likewise be positioned elsewhere.

The preferred embodiment of the invention has utilized means in the form of an air sweep for volatilizing conductive liquid material, e.g., condensed moisture and/or coating material, which may be deposited on the exposed surfaces of the insulative support which spaces the inner and outer tanks. Other volatilizing conductive devices may, of course, also be used. For example, the auxiliary volatilizing means could take the form of a heater embedded in the support. The heater would elevate the temperature of the exposed surfaces of the support sufficiently to volatilize liquid material deposited thereon. This in turn would prevent build-up of an electrically conductive film of material on the exposed surfaces of the support which, if permitted to occur, could electrically connect the inner and outer tanks.

Having described the invention, it is claimed:

1. A method of electrostatically coating articles with electrically conductive material on a continuous basis with apparatus having all exposed surfaces thereof electrically grounded comprising:

transferring uncharged electrically conductive material from an electrically grounded bulk storage tank to an inner container which is enclosed by and supported in spaced relation to an electrically grounded outer container by an insulative support physically contacting both the inner and outer containers, without establishing an electrically conductive path between said bulk storage tank and said inner container, transferring electrically conductive coating material through an electrically insulated conduit from said inner container to a spray device for emission thereby, electrostatically charging electrically conductive coating material emitted by said spray device, and sweeping a gas stream over said support while emitting electrostatically charged coating material to prevent deposition of a film of coating material on said support sufficient to conduct a substantial level of electrical current from said inner container to said outer container.

2. The method of claim 1 further including the step of detecting the quantity of coating material in said inner container and in response thereto transferring uncharged electrically conductive material from said electrically grounded bulk storage tank to said inner container without establishing electrical continuity between said bulk storage tank and said inner container.

3. The method of claim 1 wherein said step of transferring uncharged electrically conductive material from said electrically grounded bulk storage tank to said inner container includes emitting uncharged coating material to the interior of said inner container in a physically discontinuous flow.

4. The method of claim 1 further including the step of bleeding electrical current from said inner container to said outer container at a controlled rate via a resistive circuit path.

5. The method of claim 1 wherein the step of transferring said uncharged electrically conductive coating material to said inner container includes spraying uncharged coating material into said inner container through an opening in the top thereof, and wherein said gas sweeping step includes introducing a gas stream into the bottom of said outer container against said support located thereat, whereby the distance between the support and coating material vapors originating within the inner container is maximized.

6. The method of claim 5 wherein the gas sweeping step includes flowing the gas stream upwardly in the region between the inner and outer containers with a velocity sufficient to prevent gravity-induced downward movement of coating material from said inner container opening to said support.

7. The method of claim 1 wherein said gas sweeping step includes sweeping said support with relatively moisture-free gas to evaporate coating material deposited on said support.

8. The method of claim 5 further including exhausting gas from said outer container at a point above said opening in the top of said inner container.

9. The method of claim 1 wherein the gas sweeping step includes pressurizing the interior of the outer container to promote pressure flow of coating material from the inner container to the spray device via said conduit.

* * * * *